US008905596B2

(12) United States Patent
Wang He

(10) Patent No.: US 8,905,596 B2
(45) Date of Patent: Dec. 9, 2014

(54) OPTICAL LENS AND LIGHTING DEVICE HAVING SAME

(71) Applicant: Hon Hai Precision Industry Co., Ltd., New Taipei (TW)

(72) Inventor: Li-Ying Wang He, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/868,973

(22) Filed: Apr. 23, 2013

(65) Prior Publication Data

US 2014/0168994 A1 Jun. 19, 2014

(30) Foreign Application Priority Data

Dec. 17, 2012 (TW) ..... 101147763 A

(51) Int. Cl.
*F21V 5/02* (2006.01)
*F21V 5/04* (2006.01)
*F21Y 101/02* (2006.01)

(52) U.S. Cl.
CPC ..... *F21V 5/04* (2013.01); *F21Y 2101/02* (2013.01)
USPC ..... 362/311.02; 362/311.06; 362/336; 362/338; 362/340

(58) Field of Classification Search
USPC ..... 362/311.02, 311.06, 311.09, 311.1, 362/336, 338
See application file for complete search history.

(56) References Cited

U.S. PATENT DOCUMENTS 7,566,148 B2 * 7/2009 Noh et al. ..... 362/305
7,703,950 B2 * 4/2010 Ewert et al. ..... 362/339

* cited by examiner

*Primary Examiner* — Anabel Ton
(74) *Attorney, Agent, or Firm* — Novak Druce Connolly Bove + Quigg LLP

(57) ABSTRACT

An optical lens for adjusting viewing angle of and diffusing light emitted from a light emitting diode includes a light incident surface and a light emitting surface. The light incident surface is cone-shaped and concave towards the light emitting surface. The light emitting surface is cone-shaped and concave towards the light incident surface. A plurality of annular protrusions is formed on the light incident surface. The annular protrusions are coaxial and a center of each of the annular protrusions is located at an optical axis passing through a vertex of the light emitting surface and a vertex of the light incident surface. A lighting device having the optical lens and the light emitting diode is also provided.

17 Claims, 6 Drawing Sheets

OPTICAL LENS AND LIGHTING DEVICE HAVING SAME

BACKGROUND

1. Technical Field

The disclosure generally relates to an optical lens, and particularly relates to an optical lens to increase a viewing angle of a light source and a lighting device having the optical lens.

2. Description of Related Art

In recent years, due to excellent light quality and high luminous efficiency, light emitting diodes (LEDs) have increasingly been used as substitutes for incandescent bulbs, compact fluorescent lamps and fluorescent tubes as light sources of illumination devices.

Generally, light intensity of a light emitting diode (LED) gradually decreases from a middle portion to lateral sides thereof. Such a feature makes the LED unsuitable for functioning as a light source which needs a uniform illumination, for example, a light source for a direct-type backlight module for a liquid crystal display (LCD). It is required to have an optical lens which can help the light from a light emitting diode to have a wider viewing angle and a uniform intensity. Unfortunately, the conventional optical lens and a lighting device having the conventional optical lens can not obtain a satisfactory effectiveness.

What is needed, therefore, is an optical lens and a lighting device having the optical lens to overcome the above described disadvantages.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Embodiments of an optical lens and a lighting device will now be described in detail below and with reference to the drawings.

Figure 1:
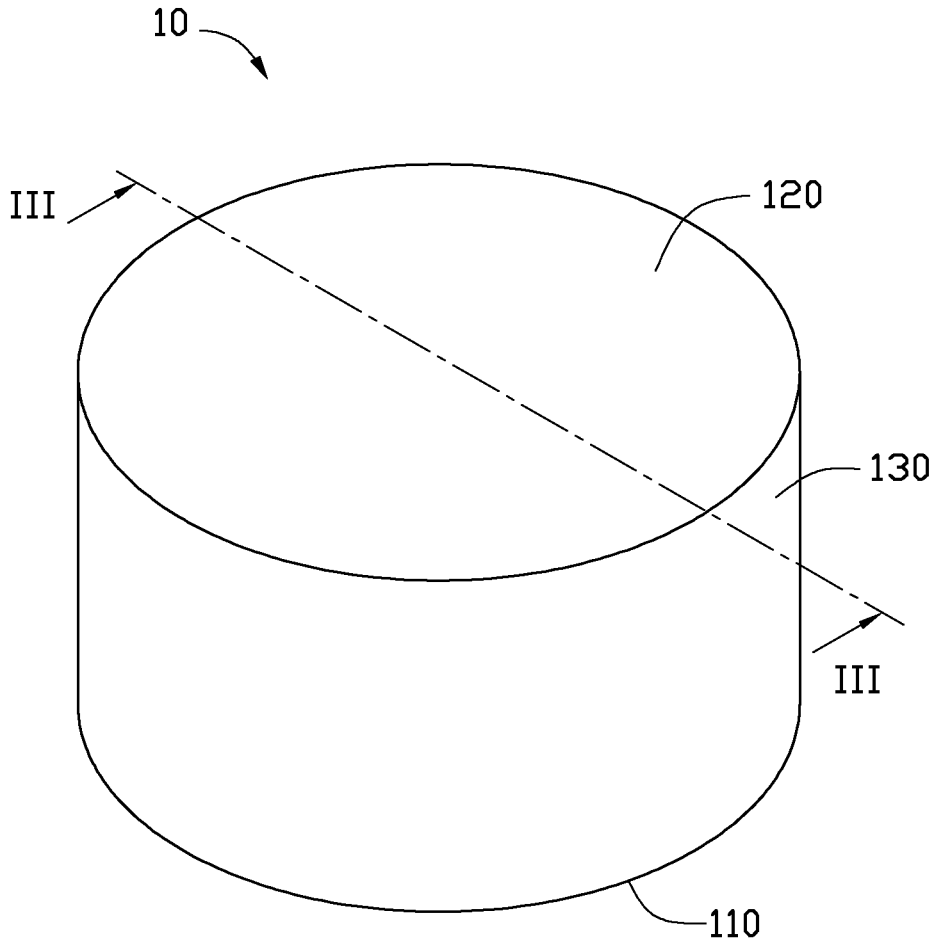
FIG. 1 is an isometric view of an optical lens in accordance with a first embodiment of the present disclosure.
Figure 2:
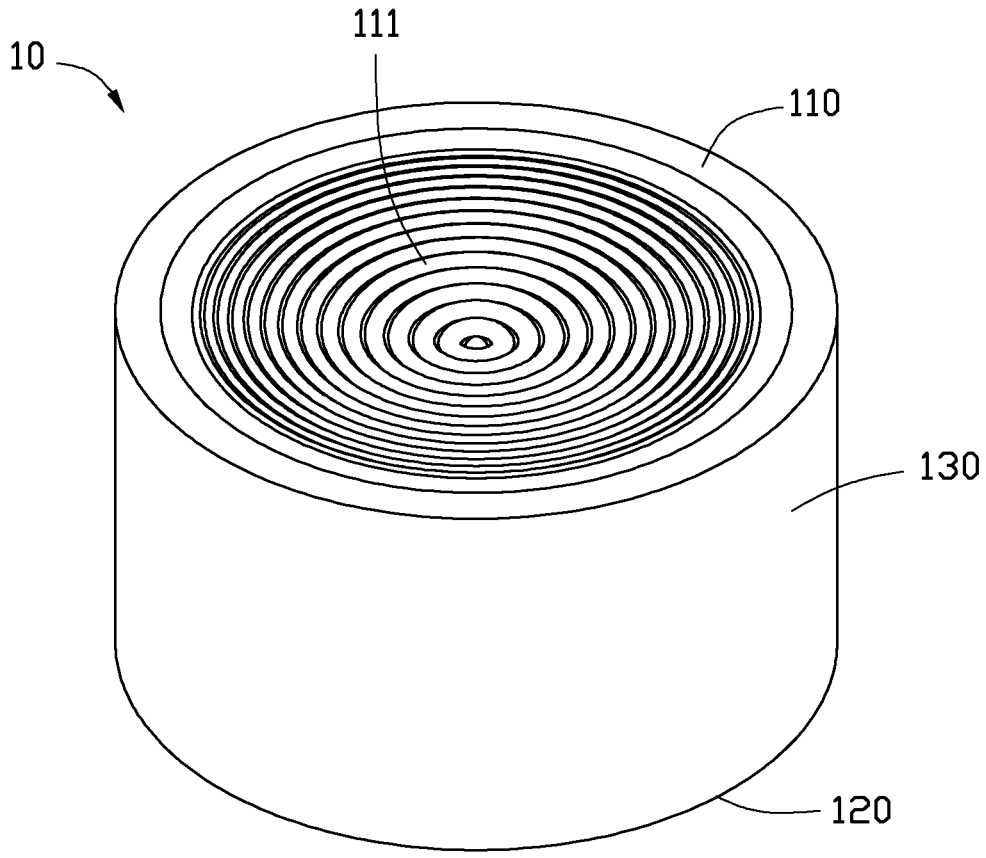
FIG. 2 is an inverted, isometric view of the optical lens in FIG. 1.
Figure 3:
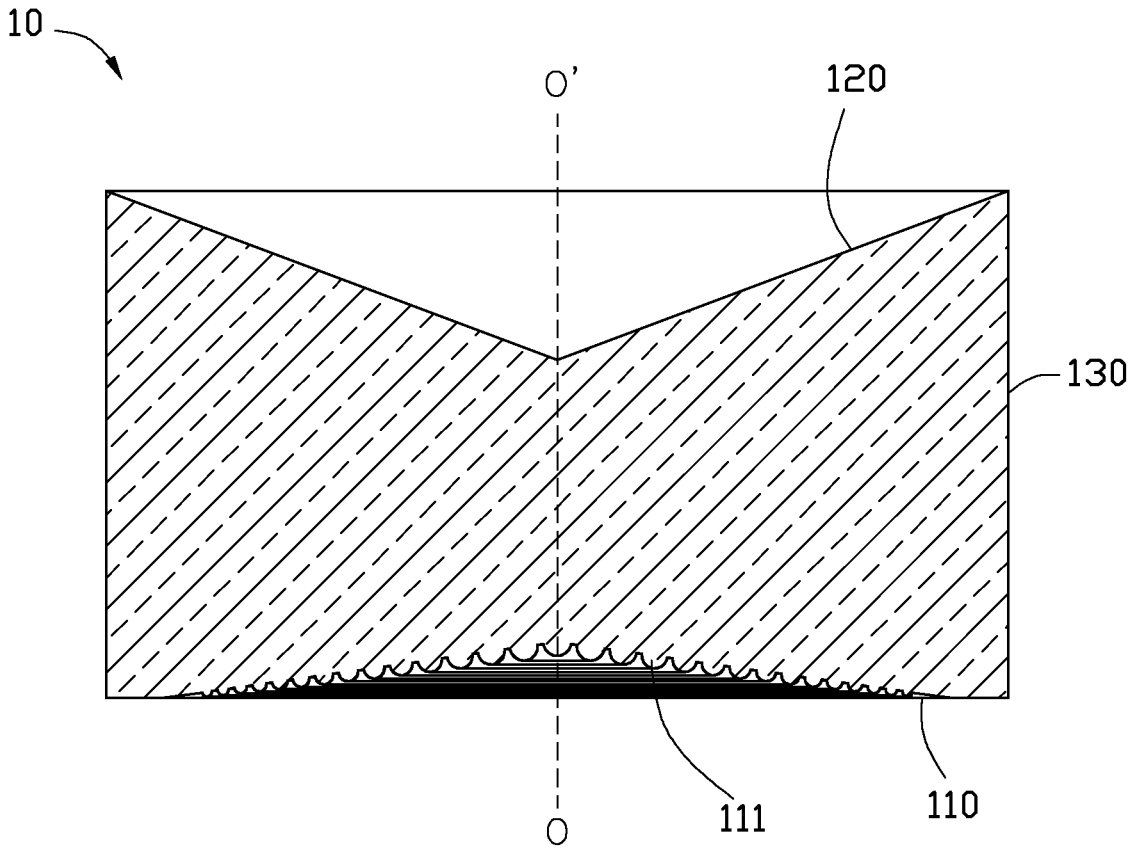
FIG. 3 is a cross sectional view of the optical lens in FIG. 1, taken along a line III-III.

Referring to FIGS. 1-3, an optical lens 10 in accordance with a first embodiment is provided. The optical lens 10 includes a light incident surface 110, a light emitting surface 120, and a side surface 130 located between and connecting the light incident surface 110 and the light emitting surface 120. The optical lens 10 is made of a material selected from a group consisting of polycarbonate (PC), polymethyl methacrylate (PMMA) and glass. In this embodiment, the optical lens 10 has an optical axis OO' and the optical lens 10 is axisymmetric around the optical axis OO'.

The light incident surface 110 is cone-shaped and concave towards the light emitting surface 120. A vertex of the light incident surface 110 is positioned at the optical axis OO' of the optical lens 10. A plurality of annular protrusions 111 are formed on the light incident surface 110. The annular protrusions 111 are coaxial and a center of each annular protrusion 111 is located at the optical axis OO'. In this embodiment, each of the annular protrusions 111 has a semicircular cross section. Preferably, a diameter of the annular protrusions 111 decreases gradually in a direction away from the optical axis OO'.

The light emitting surface 120 is cone-shaped and concave towards the light incident surface 110. In this embodiment, a vertex of the light emitting surface 120 is also positioned at the optical axis OO'.

Figure 4:
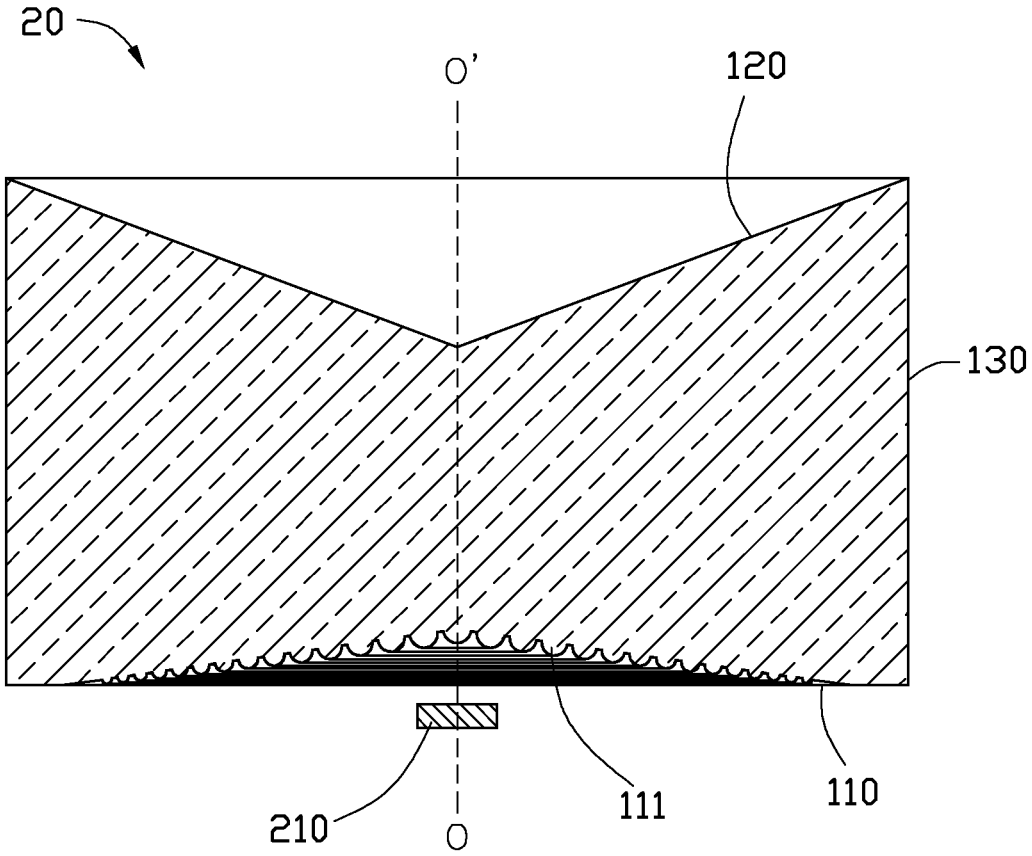
FIG. 4 is a cross sectional view of a lighting device having the optical lens in FIG. 1.

FIG. 4 shows a lighting device 20 having the optical lens 10. The lighting device 20 includes the optical lens 10 and a light emitting diode 210. The light emitting diode 210 is positioned at one side of the light incident surface 110 away from the light emitting surface 120. Light from the light emitting diode 210 emits into the optical lens 10 from the light incident surface 110, and emits out of the optical lens 10 from the light emitting surface 120. In this embodiment, the light emitting diode 210 is positioned at the optical axis OO'.

In the optical lens 10 and the lighting device 20 described above, because the light incident surface 110 is cone-shaped and has a plurality of annular protrusions 111 formed thereon, when light from the light emitting diode 210 emits into the lens 10 from the light incident surface 110, the light will be refracted by the annular protrusions 111 and emits in a direction away from the optical axis OO'. In addition, because the light emitting surface 120 is cone-shaped and concave towards the light incident surface 110, when light is emitting outside from the light emitting surface 120, the light will further be refracted by the light emitting surface 120 and emits in a direction further away from the optical axis OO'. After refracted by the light incident surface 110 and the light emitting surface 120, light from the light emitting diode 210 will emit in a direction sufficiently away from the optical axis OO'. Therefore, a viewing angle of the light emitting diode 210 is increased, and the light can be emitted uniformly in intensity from the light emitting surface 120 of the optical lens 10.

Figure 5:
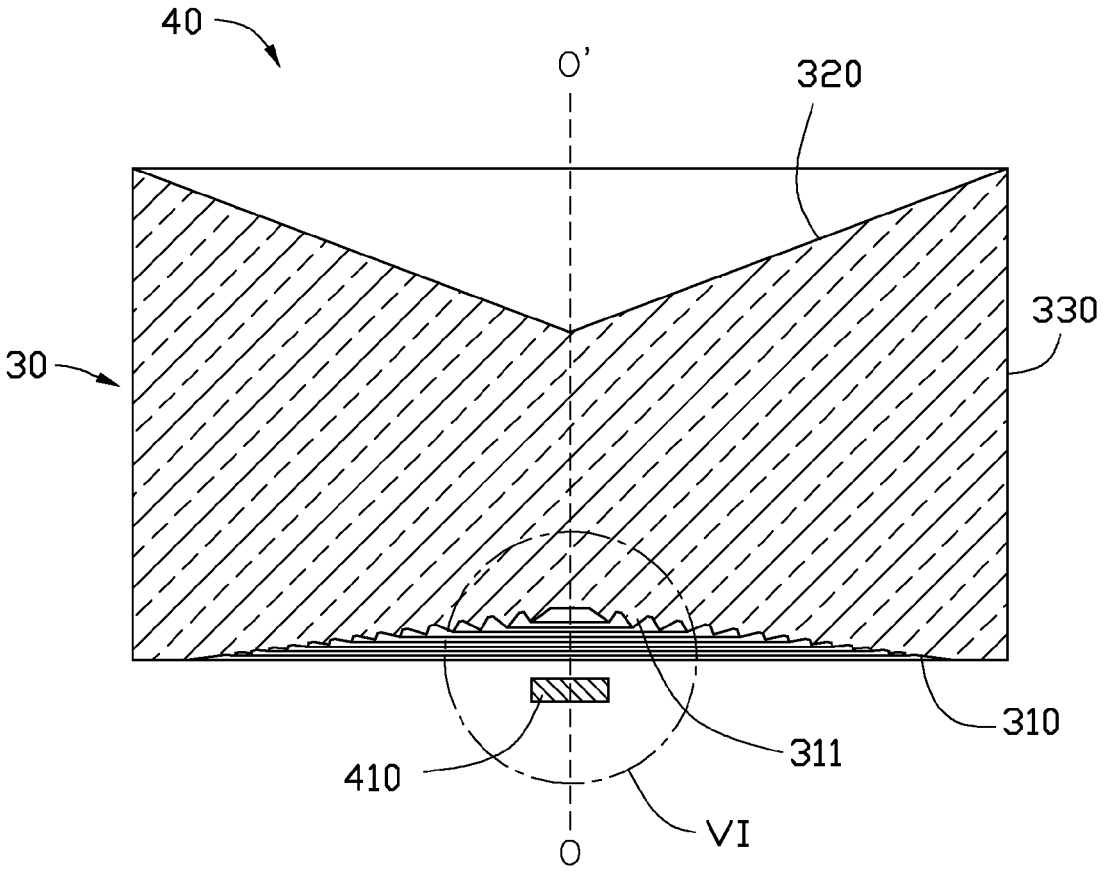
FIG. 5 is an isometric view of a lighting device in accordance with a second embodiment of the present disclosure.

Preferably, the optical lens and the lighting device are not limited to above embodiment. Referring to FIG. 5, the lighting device 40 in accordance with a second embodiment includes an optical lens 30 and a light emitting diode 410.

Figure 6:
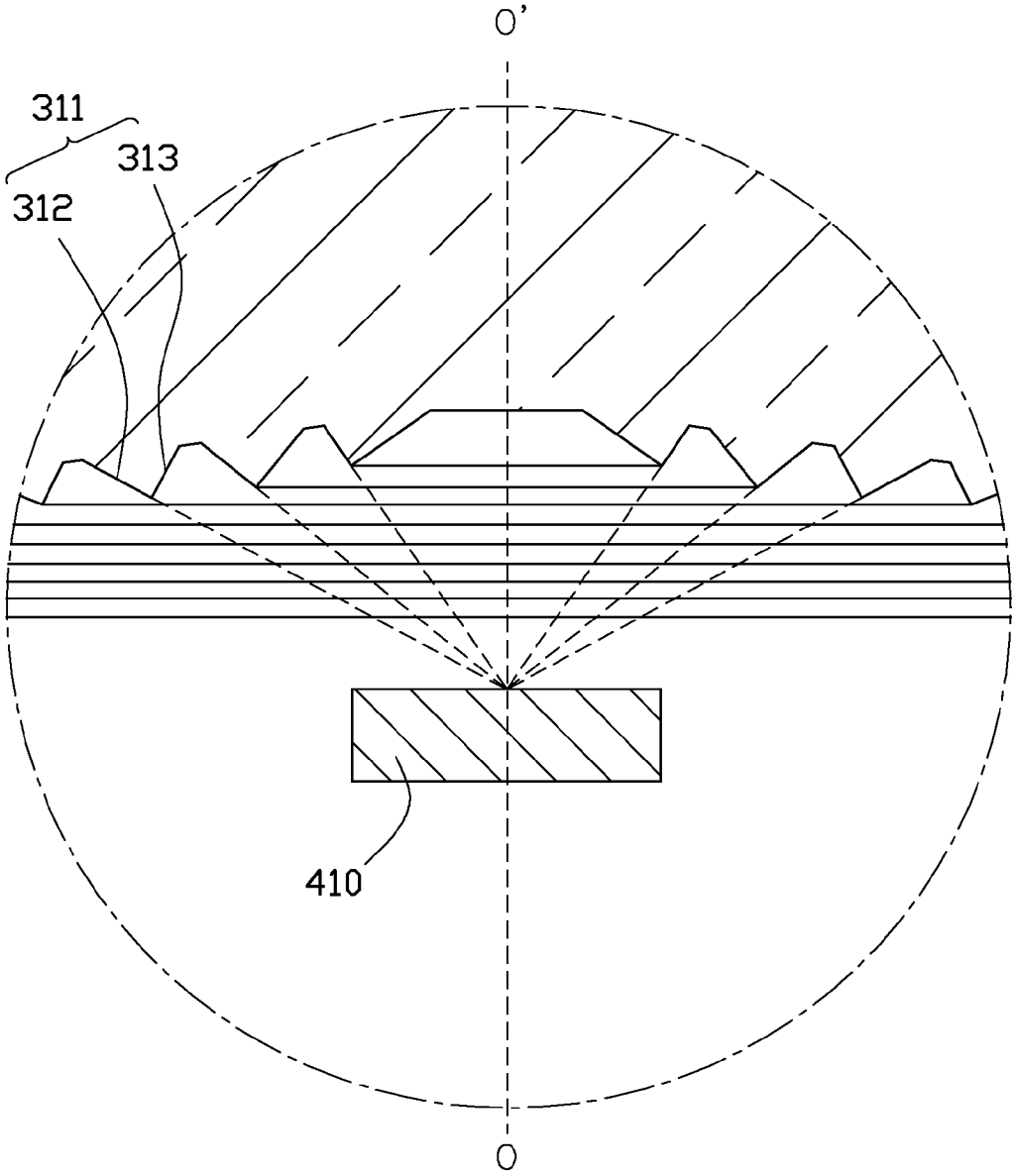
FIG. 6 is an enlarged view of part VI in FIG. 5.

The optical lens 30 includes a light incident surface 310, a light emitting surface 320 and a side surface 330 located between and connecting the light incident surface 310 and the light emitting surface 320. The light incident surface 310 is cone-shaped and concave towards the light emitting surface 320. The light emitting surface 320 is cone-shaped and concave towards the light incident surface 310. Vertexes of the light incident surface 310 and the light emitting surface 320 are positioned at the optical axis OO'. A plurality of annular protrusions 311 is formed on the light incident surface 310. The annular protrusions 311 are coaxial and a center of each of the annular protrusions 311 is located at the optical axis OO'. In this embodiment, each of the annular protrusions 311 has a triangular cross section. Referring to FIG. 6, each of the annular protrusion 311 includes a first surface 312 and a second surface 313. The first surface 312 is a part of a cone. The cones have a common vertex, which is positioned at the optical axis OO' of the optical lens 30. Preferably, an included angle between the first surface 312 and the second surface 313 is less than 90 degrees.

The light emitting diode 410 is formed at one side of the light incident surface 310 away from the light emitting surface 320. In this embodiment, the common vertex of the cones defined by the first surfaces 312 is located at a light output surface of the light emitting diode 410. When the light emitting diode 410 emits light, most of the light from the light emitting diode 410 will emit into the optical lens 30 from the second surface 313 of the annular protrusion 311. At that time, the second surface 313 will refract light from the light emitting diode 410 and make it emits in a direction away from the optical axis OO'. When the light is emitted outwards from the light emitting surface 320, the light will further be refracted by the light emitting surface 320 and emit in a direction further away from the optical axis OO'. Therefore, a viewing angle of the light emitting diode 210 is increased, and the light can be emitted uniformly in intensity from the light emitting surface 320 of the optical lens 30.

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An optical lens for increasing viewing angle of and evenly diffusing light from a light emitting diode, comprising:

a light incident surface; and a light emitting surface;

wherein the light incident surface is cone-shaped and concave towards the light emitting surface, the light emitting surface is cone-shaped and concave towards the light incident surface, the optical lens further comprises a plurality of annular protrusions formed on the light incident surface, the annular protrusions are coaxial and a center of each of the annular protrusions is located at an optical axis of the lens which extends through a vertex of the light emitting surface and a vertex of the light incident surface.

2. The optical lens of claim 1, wherein each of the annular protrusions has a semicircular cross section.

3. The optical lens of claim 2, wherein a diameter of the cross section of each of the annular protrusions gradually decreases in a direction away from the optical axis.

4. The optical lens of claim 1, wherein each of the annular protrusions has a triangular cross section.

5. The optical lens of claim 4, wherein each of the annular protrusions comprises a first surface and a second surface, and an included angle between the first surface and the second surface is less than 90 degrees.

6. The optical lens of claim 5, wherein the first surface is a part of a cone, and a vertex of the cone defined by the first surface is positioned at the optical axis.

7. The optical lens of claim 6, wherein the first surfaces of the annular protrusions are oriented to a same point.

8. The optical lens of claim 1, wherein optical lens is made of a material selected from a group consisting of polycarbonate, polymethyl methacrylat and glass.

9. A lighting device, comprising:

an optical lens comprising a light incident surface and a light emitting surface, the light incident surface being cone-shaped and concave towards the light emitting surface, the light emitting surface being cone shaped and concave towards the light incident surface, a plurality of annular protrusions being formed on the light incident surface, the annular protrusions being coaxial and a center of each of the annular protrusions being located at an optical axis of the lens which extends through a vertex of the light emitting surface and a vertex of the light incident surface; and a light emitting diode formed at one side of the light incident surface away from the light emitting surface, light from the light emitting diode emitting into the optical lens via the light incident surface and emitting out of the optical lens via the light emitting surface, the light being diverged by the annular protrusions at the light incident surface and further diverged by the light emitting surface.

10. The lighting device of claim 9, wherein each of the annular protrusions has a semicircular cross section.

11. The lighting device of claim 10, wherein a diameter of the cross section of each of the annular protrusions gradually decreases in a direction away from the optical axis.

12. The lighting device of claim 9, wherein each of the annular protrusions has a triangular cross section.

13. The lighting device of claim 12, wherein each of the annular protrusions comprises a first surface and a second surface, and an included angle between the first surface and the second surface is less than 90 degrees.

14. The lighting device of claim 13, wherein the first surface is a part of a cone, and a vertex of the cone defined by the first surface is positioned at the optical axis.

15. The lighting device of claim 14, wherein the first surfaces of the annular protrusions are oriented to a same point.

16. The light device of claim 15, wherein a light output surface of the light emitting diode is located at the same point.

17. The lighting device of claim 9, wherein optical lens is made of a material selected from a group consisting of polycarbonate, polymethyl methacrylat and glass.

* * * * *